United States Patent [19]

Beránek et al.

[11] 4,325,311

[45] Apr. 20, 1982

[54] METHOD AND EQUIPMENT FOR TREATMENT OF FUEL FOR FLUIDIZED BED COMBUSTION

[76] Inventors: Jaroslav Beránek; Jan Čermák, both of Prague; Jaroslav Dobrozemský, Uhliska; Vratislav Fibinger, Vaclava Vacka, all of Czechoslovakia

[73] Assignee: Ceskoslovenska akademie ved, Prague, Czechoslovakia

[21] Appl. No.: 150,317

[22] Filed: May 16, 1980

[30] Foreign Application Priority Data

May 17, 1979 [CS] Czechoslovakia ..... 3424-79

[51] Int. Cl.[3] ..... F22B 1/00

[52] U.S. Cl. ..... 110/245; 110/347; 44/1 A

[58] Field of Search ..... 44/1 A; 110/245, 347, 110/342, 106, 221, 224, 232

[56] References Cited

U.S. PATENT DOCUMENTS

| | | | |
|---|---|---|---|
| 1,942,687 | 1/1934 | Daniels | 110/232 |
| 3,366,080 | 1/1968 | Albertson | 110/245 |
| 3,677,404 | 7/1972 | Staffin | 110/221 |
| 3,888,193 | 6/1975 | Kishigami et al. | 110/245 |
| 3,897,739 | 8/1975 | Goldbach | 110/245 |
| 3,921,590 | 11/1975 | Mitchell et al. | 110/245 |
| 3,955,512 | 5/1976 | Martin et al. | 110/255 |

*Primary Examiner*—Henry C. Yuen

*Attorney, Agent, or Firm*—Burgess, Ryan and Wayne

[57] ABSTRACT

The invention relates to the method and equipment for treatment of fuel for fluidized bed combustion, which includes drying, classification and crushing of the fuel. The method for treatment of fuel comprises mixing the fuel with hot ash removed from the fluidized bed combustor and drying said mixture in a fluidized bed dryer in which the velocity of the fluidization fluid equals or is lower than the minimum fluidization velocity of particles in the fluidized bed combustor. The equipment for treatment of fuel comprises a bunker, crusher and dryer, comprising a fluidized bed dryer provided with appropriate piping for interconnection of the fluidized bed dryer, fluidized bed combuster, fuel bunker and crusher.

2 Claims, 1 Drawing Figure

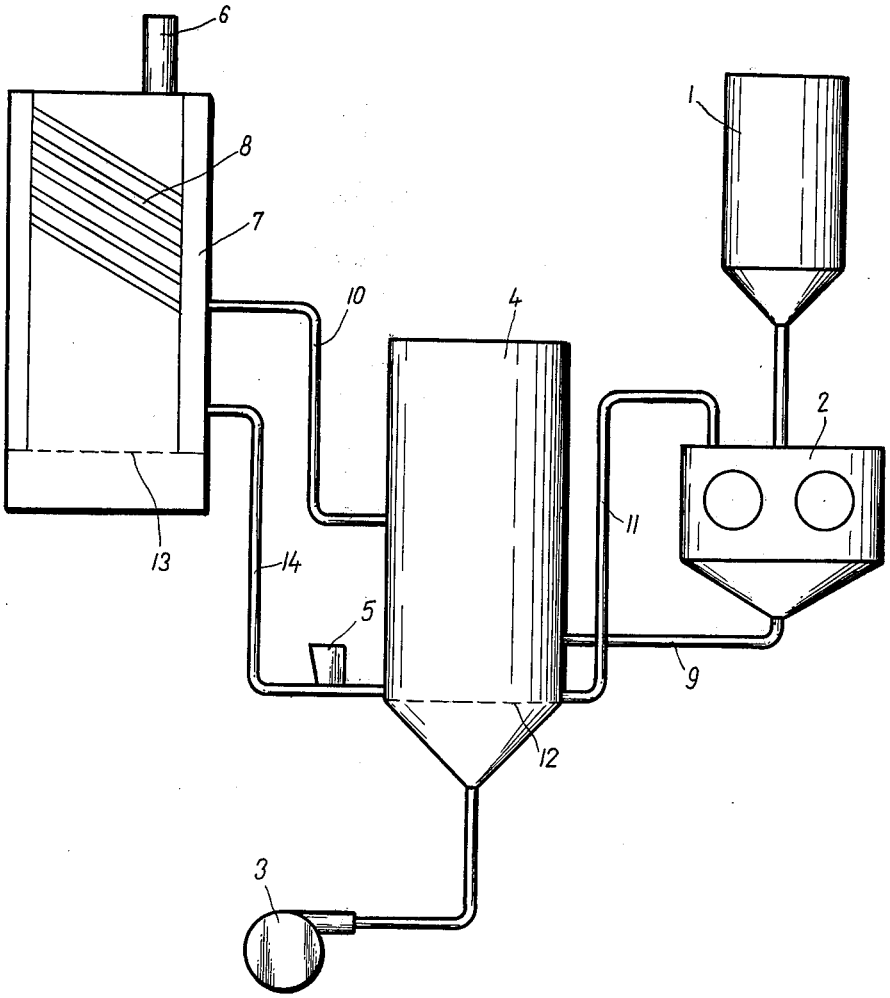
6
8
7
10
4
1
2
11
13
14
5
9
12
3

METHOD AND EQUIPMENT FOR TREATMENT OF FUEL FOR FLUIDIZED BED COMBUSTION

The invention relates to a method and equipment for treatment of fuel for fluidized bed combustion, which includes drying, classification and crushing of fuel.

BACKGROUND OF THE INVENTION

By combustion of fuel in steam generators and combustion equipment having a fluidized bed furnace, the size of fuel particles must be such as to enable, at the lowest thermal or steam output of the equipment, that is at the smallest flow rate of combustion air, fluidization of all particles both of fuel and solid residues from the combustion process. In addition, the fuel must be granular to enable its delivery at multiple points of the fluidized bed. It is also usually assumed that there must be at least one fuel inlet must be situated per square meter of the fluidized bed area. Fluidized bed combustors use particles coarser by at least two orders of magnitude in comparison with particle sizes used at present with steam generators for combustion of powdery fuels. Thus, it is not possible to use standard types of crushers and classifiers. Therefore, simultaneously with the development of steam generators with fluidized bed combustors the development of equipment for treatment of fuel must take place.

In equipment used at present for treatment of fuel for combustion, the fuel is dried by hot exhaust gases, or by hot air by steam. In drying of fuels by exhaust gases, the gases are sucked in by turbo-blowers and are compressed to the pressure needed for classification and transport of coal dust, the particles of fuel are picked up by exhaust gases simultaneously from the crushers and passed to classifiers from which the coarse particles return back in the crusher. From the classifiers, the fuel is conveyed together with secondary air into the combustor. (Perry J. H.—Chemical Eng. Handbook 9–19 and next pages, McGraw Hill 1963). The steam dryers are seldom used and are situated ahead of the crusher in which the fuel is again finally dried by hot gases. For drying of the fuel by hot air, the arrangement of the equipment is similar to that for drying of fuels by hot exhaust gases. The purpose of the invention is to present a simpler and more effective method and apparatus for treatment of fuels by drying and classification by use of waste heat of combustion in fluidized bed furnaces.

BRIEF SUMMARY OF THE INVENTION

The fuel for fluidized bed combustion is treated by the method according to the present invention whose principle is based on the fact, that the fuel is mixed with ash removed from the fluidized bed combustor and is introduced into the fluidized bed dryer in which the velocity of the fluidization fluid equals or is smaller than the minimum fluidization velocity of particles in the fluidized bed combustor while the amount of ash being introduced depends on the temperature. The dried fuel particles are removed from the fluidized bed in the dryer and fed into the fluidized bed combustor. The coarser particles from the bottom of the fluidized bed dryer are conveyed to the crushing mill and are from there transported again into the fluidized bed dryer.

The temperature of the fluidized bed in the dryer cannot exceed the value corresponding to the limit of inflammability. This temperature then corresponds to the inlet flow of ash from the fluidized bed furnace. The flow of the fluidization fluid which could be air or exhaust gases is chosen so that in the fluidized bed dryer all particles are classified. Particles of fuel, which are larger, have a minimum fluidization velocity higher than the minimum fluidization velocity of particles in the fluidized bed furnace and are removed from the bottom of the fluidized bed dryer and are fed back into the crushing mill. The crushed fuel particles are added to the stream of the raw fuel fed into the fluidized bed dryer.

DETAILED DESCRIPTION OF THE INVENTION

The advantage of the method of the present invention for treatment of fuel lies in its simplicity and small size of the equipment. The exhaust gases are not withdrawn from the steam generator for drying of fuel so that variation in the flow rate of exhaust gases through additional heat exchangers does not take place in dependence on the moisture content of the fuel. Another advantage is that particles which do not fluidize are not delivered into the fluidized bed combustor so that accumulation of non-fluidizing particles in the space above the grid does not take place as usually occur when mechanical methods of classification of particles are used.

The present method for treatment of fuel for fluidized bed combustion is performed in equipment according to the invention consisting of fuel bunker, crusher and dryer, which comprises a fluidized bed dryer provided with piping for introduction of fuel from the crusher into the said fluidized bed dryer and piping for introduction of hot ashes from fluidized bed combustor to said fluidized bed dryer and fluidized bed seal and piping for removal of fluidized particles from fluidized bed dryer to fluidized bed combustor and arrangement for removal of nonfluidizing particles from the bottom of fluidized bed dryer back to the fuel crusher.

The FIGURE illustrates the equipment for treatment of fuel for fluidized bed combustion.

Equipment for treatment of fuel for fluidized bed combustion comprises the fuel bunker 1 and crusher 2. The crusher 2 is connected by piping 9 for introducing fuel into the fluidized bed dryer 4 and by piping 10 for introducing hot ash from the fluidized bed combustor 7 into the dryer. The fluidized bed dryer 4 is moreover equipped with the fluidized bed seal 5 and piping 14, enabling transfer of dried fuel particles together with particles of ash into the fluidized bed furnace 7. The fluidized bed dryer 4 is moreover equipped with the turbo-blower 3, delivering the fluidization fluid below the grid 12, of the fluidized bed dryer 4. Fuel particles which are larger and whose minimum fluidization velocity is higher than the minimum fluidization velocity of particles in the fluidized bed furnace 7 are accumulated above the grid 12 of the fluidized bed dryer 4 and are carried back through the piping 11 into the crusher 2 of raw fuel. The fluidized bed furnace 7 is moreover equipped with the heat exchanger 8, grid 13 and piping 6 for removal of exhaust gases.

The invention is described in the following example of arrangement, without any limitations.

EXAMPLE

In the fluidized bed combustor 7 was burned brown coal which contained 38% by mass of water, 17.5% by mass of ash and 3% by mass of sulphur. The raw fuel in particle sizes up to 15 mm is charged from the crusher 2 at the flow rate of 1.2 ton/m$^2$ area of the fluidized bed per hour, into the fluidized bed dryer 4 together with ash removed from the fluidized bed furnace 7 at the temperature 840° C. The flow of removed ash was controlled so as to keep the temperature of the fluidized bed in the fluidized bed dryer 4 at the temperature range from 85° to 90° C. Superficial velocity of air flowing through the fluidized bed of the dryer was 1.1 m/s and corresponded to the fluidization velocity of particles in the fluidized bed furnace 7 at the lowest thermal output. From the top of the fluidized bed dryer 4 there was removed through the fluidized bed seal 5 a mixture of particles of fuel with ash at the flow of 0.8 metric ton/m$^2$ area of the fluidized bed per hour and was fed into the fluidized bed combustor 7. Non-fluidizing particles of fuel were removed from the space close the bottom of the fluidized bed dryer 4 and after crushing in the cylindrical crusher 2 were returned back into the fluidized bed dryer 4.

We claim:

1. A method for treatment of particulate fuel for fluidized bed combustion in a fluidized bed combustor, comprising: removing hot particles from the bed of said combustor and passing same to a fluidized bed dryer, mixing the fuel with the hot particles removed from the bed of the fluidized bed combustor and, drying the mixture at a drying temperature in the fluidized bed dryer while introducing fluidization fluid to said dryer at a velocity not greater than the minimum fluidization velocity of particles in the fluidized bed combustor, removing particles from the fluidized bed in the dryer, charging the same to the fluidized bed combustor, removing particulate material which fluidizes at a fluidizing fluid velocity higher than the fluidizing fluid velocity in the fluidized bed dryer from the bottom of the bed in the fluidized bed dryer, and passing the same to a crusher wherein the particle size is reduced, and returning the particulate material having a reduced particle size to the fluidized bed dryer.

2. A method according to claim 1, further comprising controlling the temperature in the fluidized bed dryer by controlling the amount of flow of hot particles from the fluidized bed combustor which are mixed with the fuel.

* * * * *

UNITED STATES PATENT AND TRADEMARK OFFICE

CERTIFICATE OF CORRECTION

PATENT NO. : 4,325,311

DATED : April 20, 1982

INVENTOR(S) : Beranek, et al

It is certified that error appears in the above—identified patent and that said Letters Patent is hereby corrected as shown below:

Column 1, line 19: "must be situated" should be cancelled.

Column 3, line 18: "back into" should be --to--.

Signed and Sealed this

*Twenty-first* Day of *December 1982*

[SEAL]

*Attest:*

GERALD J. MOSSINGHOFF

*Attesting Officer*

*Commissioner of Patents and Trademarks*